United States Patent [19]

Johnson

[11] Patent Number: 4,482,179

[45] Date of Patent: Nov. 13, 1984

[54] DOOR HANDLE ASSEMBLY

[75] Inventor: James J. Johnson, Southfield, Mich.

[73] Assignee: General Motors Corporation, Detroit, Mich.

[21] Appl. No.: 450,051

[22] Filed: Dec. 15, 1982

[51] Int. Cl.[3] ..... E05C 21/00

[52] U.S. Cl. ..... 292/336.3; 74/107; 74/99 A

[58] Field of Search ..... 292/336.3, 165, 227, 292/DIG. 37, 172, 223, 226; 74/99 A, 99 R, 107

[56] References Cited

U.S. PATENT DOCUMENTS 948,119 2/1910 Wettig ..... 292/227 X 2,749,098 6/1956 Johnson ..... 74/99 X 4,322,711 3/1982 Spangler et al. ..... 74/99 R X

*Primary Examiner*—Richard E. Moore

*Attorney, Agent, or Firm*—Patrick M. Griffin

[57] ABSTRACT

A push button type or a pull out type door handle is provided with a latch operating mechanism for actuating a vehicle door latch. In each embodiment, a mounting member attached to the vehicle door rotatably mounts a latch release lever for movement in a plane generally parallel to the door. The push button or pull out handle moves an elongated rod having a helical twist through a camming opening of like cross-section in the latch release lever to rotate the lever and release the door latch.

2 Claims, 8 Drawing Figures

DOOR HANDLE ASSEMBLY

This invention relates generally to door handle assemblies and more particularly to an improved operating mechanism of such an assembly.

BACKGROUND OF THE INVENTION

Conventional door handle assemblies, either of the push button type or pull out type, include a series of bell cranks for converting the linear movement of the push button or of the handle transversely of the vehicle door into vertical linear movement in order to operate the vehicle door latch. In certain vehicle doors, due to the lesser spacing than normal of the inner and outer panels, it is difficult to fit such operating mechanism into the available space.

SUMMARY OF THE INVENTION

The door handle assembly of this invention includes an improved operating mechanism which directly converts movement of the push button or the pull out handle into rotary motion of an operating lever to release the door latch. In the preferred embodiments of the invention, the push button or the pull out handle includes a helically twisted operating member which moves within a generally like shaped opening of a rotatable lever in order to rotate the lever and release the latch which is connected to the lever by a rod or other fixed length member. The helically twisted member is of generally square cross-section although it can be of other shapes. The opening in the operating lever includes generally concave arcuate sides so as to reduce the contact area between the twisted member and the opening to a minimum for ease of operation.

The primary feature of this invention is that it provides an improved operating mechanism for a vehicle body door handle assembly which includes a helically twisted linearly movable operating member engageable within an opening of a rotatably mounted lever to rotate the lever and release a vehicle door latch operatively connected to the lever. A further feature is that the opening in the rotatable lever conforms to the cross-section of the operating member intermediately of the rotatable lever so as to reduce friction therebetween to a minimum.

These and other features will be readily apparent from the following specification and drawings wherein.

DESCRIPTION OF THE PREFERRED EMBODIMENT

Figure 1:
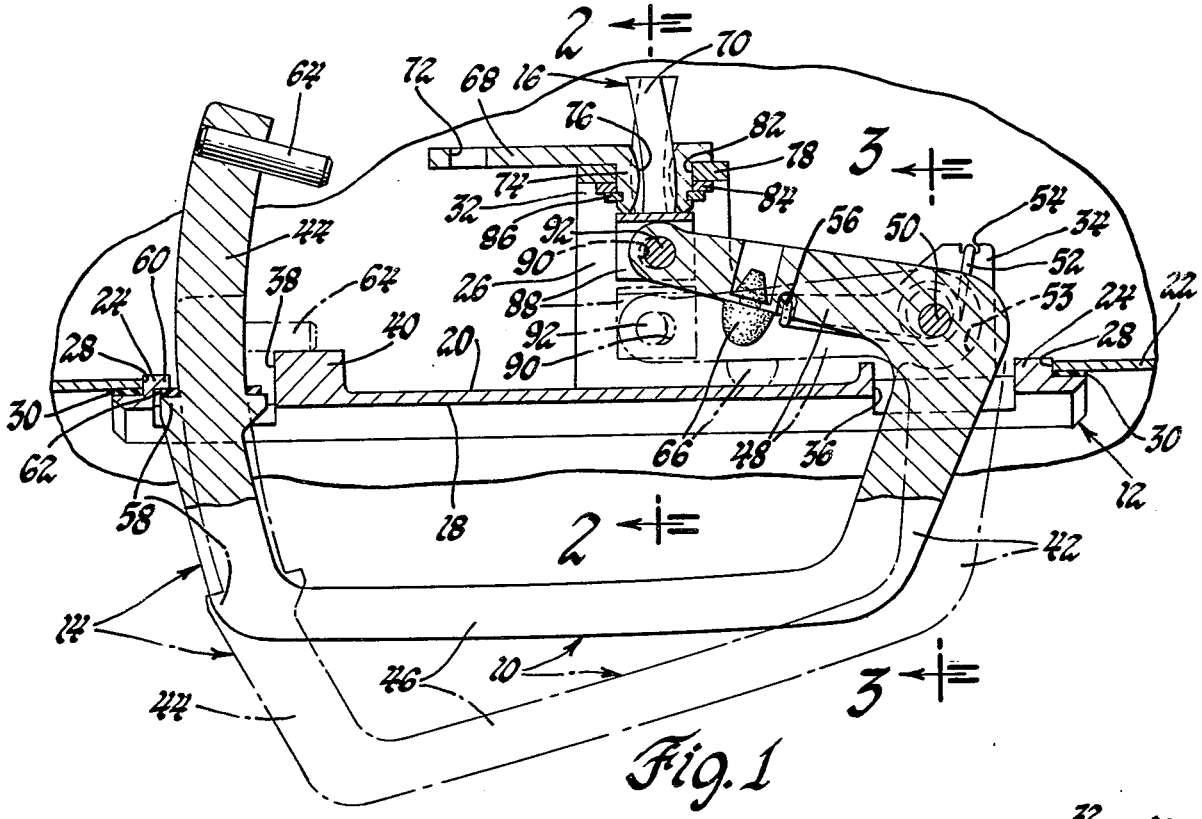
FIG. 1 is a partial broken away view of a pull out type door handle assembly embodying an operating mechanism according to this invention, with the handle being shown in inoperative position in full lines and in operative position in dash lines.

Referring first to FIG. 1, the pull out type handle embodiment of the invention designated generally at 10 includes an escutcheon or mounting member 12, an actuating member or generally U-shaped pull out handle 14, and a latch operating mechanism designated generally 16. Handle 14 and operating mechanism 16 are shown in an inoperative position in solid lines and in an operative position in dash lines.

Mounting member 12 includes a visible outer wall 18 and a non-visible inner wall 20 respective the interior space between the vehicle door outer panel 22 and the door inner panel, not shown. Inner wall 20 includes a continuous rib 24 which is offset from the peripheral edge thereof and coterminus, along the top and bottom, with a pair of generally L-shaped inwardly extending flanges 26, the bottom one of which is visible in FIG. 1 and both of which are visible in cross-section in FIG. 2. Rib 24 and flanges 26 together fit within an aperture 28 in door panel 22, best seen in FIGS. 2 and 3, cushioned by a peripheral gasket 30 or the like. Mounting member 12 is secured to panel 22 by conventional means, not shown. L-shaped flanges 26 extend over approximately half of inner wall 20 and provide a first clevis 32, best visible in FIG. 2, near the center of inner wall 20 and a second clevis 34, best visible in FIG. 3. Mounting member 12 is slanted, as visible in FIGS. 2 and 3, to match the contour of door panel 22 and the lower leg of each clevis 32 and 34 extends inwardly a greater extent to compensate therefor. Mounting member 12 further includes first and second apertures 36 and 38 proximate either end thereof. The first aperture 36 opens through clevis 34, visible in FIG. 3. Finally a stop block 40 is integral with inner wall 20 proximate to second aperture 38, the purpose of which will be described below.

Referring again to FIG. 1, the pull out handle 14 includes a first leg 42 which extends through first aperture 36, a relatively longer arcuate second leg 44 which extends through second aperture 38 and a gripping portion 46 interconnecting the two legs. First leg 42 includes a lateral extension 48 which extends substantially normal thereto and terminates generally between the legs of clevis 32, FIG. 2, where it is joined to latch operating mechanism 16 as will be described further below. Handle 14 is rotatably mounted on a pivot pin 50 which extends between and is fixed to the legs of clevis 34. Handle 14 is continually biased in a clockwise direction as viewed in FIG. 1 by a coil spring 52 which is wound around pivot pin 50 within a recess 53 at the juncture of leg 42 and extension 48, and hooked at one end to a notch 54 in the bottom leg of clevis 34 and at the other end to an aperture 56 in extension 48, FIG. 1. Under the force of spring 52, a flange or shoulder 58 on leg 44 engages a flange or shoulder 60 within aperture 38 to set the inoperative position of handle 14, shown in solid lines. This engagement is cushioned by a resilient element 62. When handle 14 is rotated counterclockwise out by an operator, a stop pin 64 near the terminus of second leg 44 engages stop block 40 to set the operative position of handle 14 shown in dash lines in FIG. 1. As pin 64 engages stop block 40, a resilient bumper 66 on extension 48 engages inner wall 20 to cushion this engagement. Rotation of handle 14 actuates latch operating mechanism 16 as will be described below.

Figure 2:
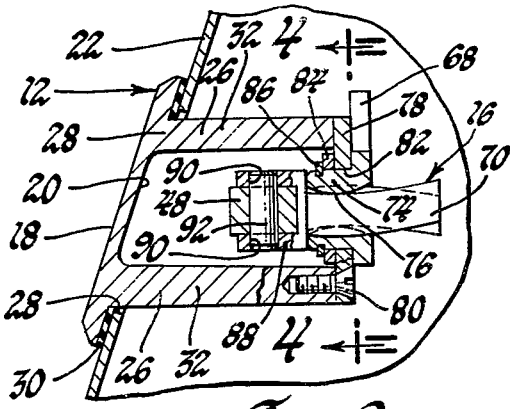
FIG. 2 is a view taken generally along the plane indicated by line 2—2 of FIG. 1.
Figure 3:
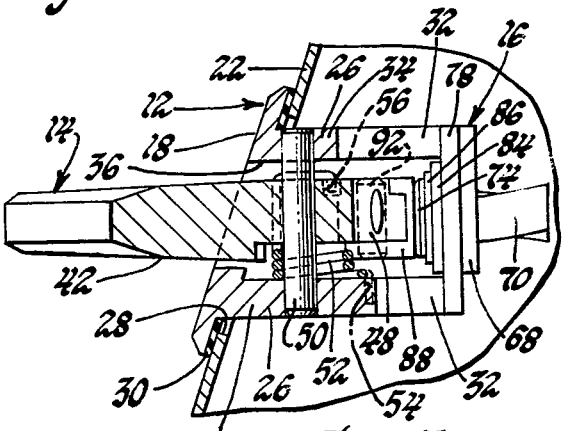
FIG. 3 is a view taken generally along the plane indicated by line 3—3 of FIG. 1.
Figure 5:
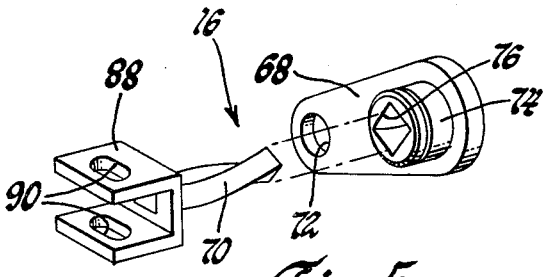
FIG. 5 is an exploded perspective view of a portion of the operating mechanism.

Referring to FIG. 5, the latch operating mechanism 16 includes a latch release lever 68 and a camming member comprised of an elongated, square cross-section rod 70 which has a helical twist therein which covers a predetermined angle over a predetermined axial length thereof. In the embodiment disclosed, the angle is approximately 45° over ½" of axial length. Latch release lever 68 has an aperture 72 at one end and a cylindrical bearing boss 74 at the other end which has an elongated axial opening 76 receiving rod 70. As best seen in FIGS. 1 and 2, opening 76 has generally arcuate sides providing a flared exit and entrance and a center of a cross-section substantially identical to that of rod 70.

Figure 4:
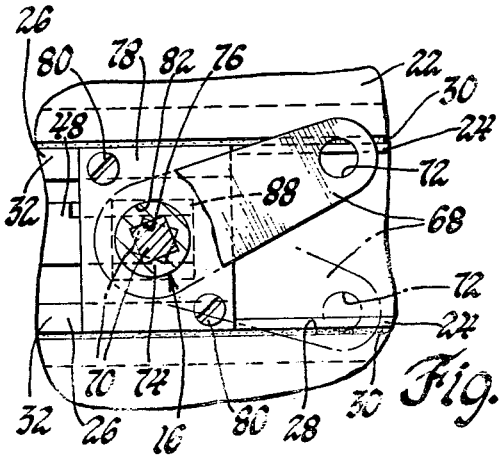
FIG. 4 is a view taken along line 4—4 of FIG. 2.

Referring now to FIG. 4, a mounting plate 78 is joined by screws 80 to the ends of the legs of clevis 32. Cylindrical boss 74 is journalled in an aperture 82 in mounting plate 78 and rotatably attached thereto by a washer 84 and C-clip 86 which snaps into a groove in the boss. A clevis 88 is attached to one end of rod 70 and the legs thereof include elongated openings 90. The openings receive the ends of a pin 92 fixed to extension 48 to pivotally and slidably connect the handle 14 and rod 70.

The operation of latch operating mechanism 16 may now be understood by referring to FIGS. 1 and 4. As pull out handle 14 is moved from the full line inoperative position to the dash line operative position of FIG. 1, elongated rod 70 is pulled through opening 76 to rotate latch release lever 68 through an arc of approximately 45° from the full line inoperative position of FIG. 4 to the dash line operative position therein. This moves a conventional latch release rod, not shown, attached to aperture 72, downwardly to operate the door latch. The parameters of movement of lever 68 can be varied by varying the length of the helical twist of rod 70 and the length of the release lever. A relatively small movement of rod 70 in a direction perpendicular to the door can result in a relatively large rotative motion of lever 68 in a direction parallel to the door. Additionally, the relation of the length of extension 48 to the length of gripping portion 46 gives an approximate 2:1 mechanical advantage in operating latch release mechanism 16. This helps provide smooth and easy operation.

Figure 6:
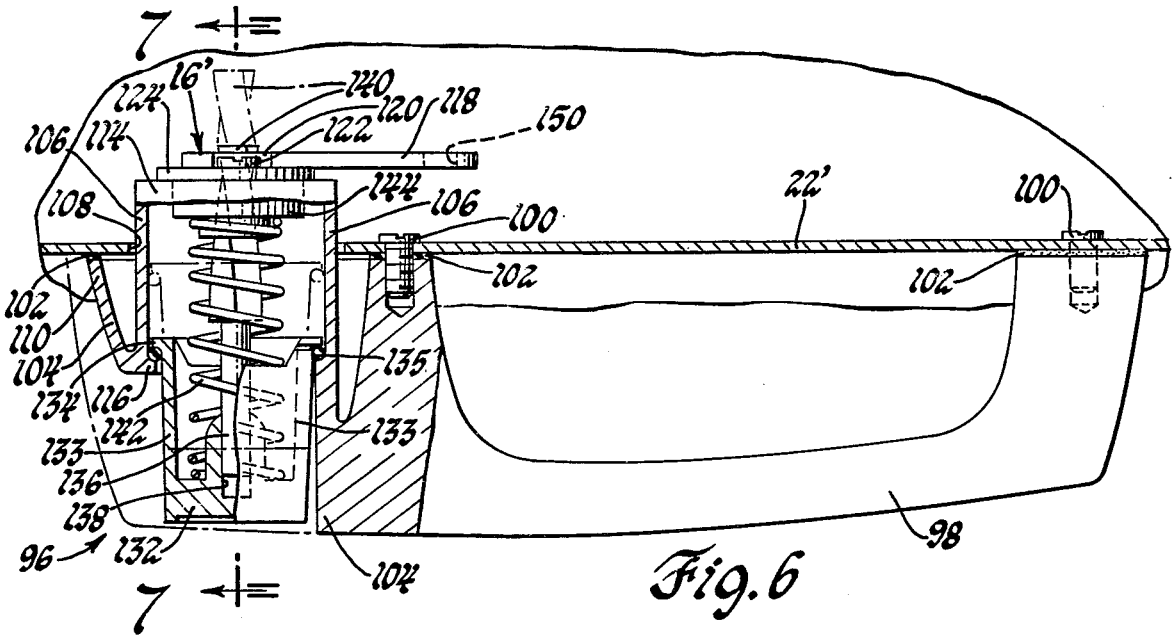
FIG. 6 is a partial broken away view of a push button type handle embodying an operating mechanism according to this invention.
Figure 7:
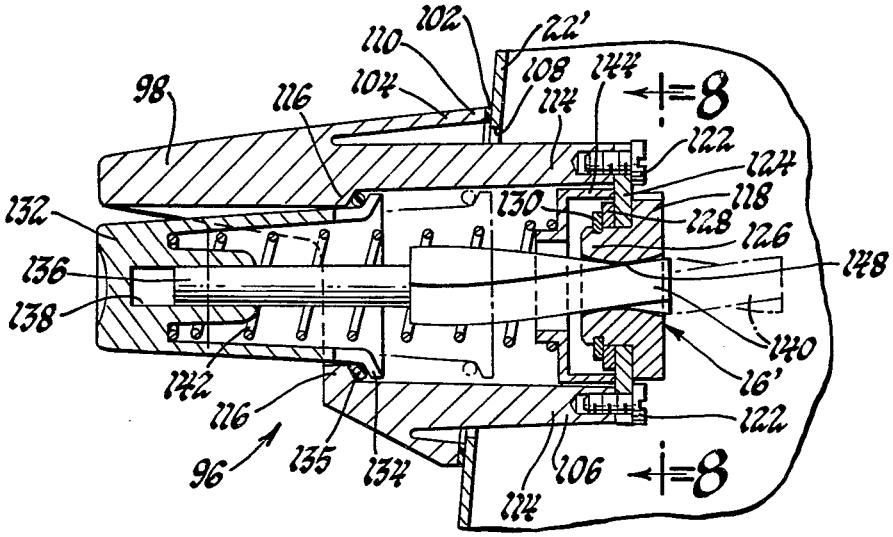
FIG. 7 is an enlarged sectional view taken generally along line 7—7 of FIG. 6.
Figure 8:
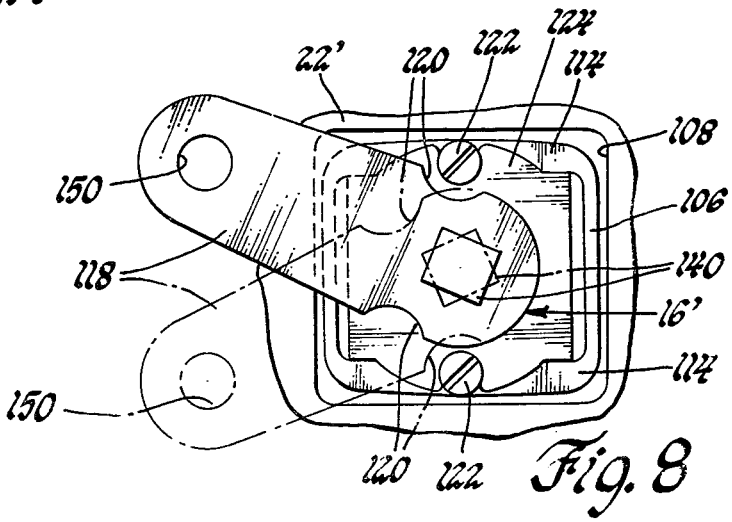
FIG. 8 is a view taken along line 8—8 of FIG. 7.

Referring now to FIGS. 6 through 8, a push button type handle embodiment of the invention is designated generally 96. Referring first to FIG. 6, a generally C-shaped handle 98 is attached by screws 100 to the door panel 22 and cushioned at each end by gaskets 102. The left hand end of handle 98 includes outer and inner nested housings of a general box-shape designated at 104 and 106. As best seen in FIG. 7, inner housing 106 is hollow and extends through an aperture 108 in panel 22, while the surrounding peripheral edge 110 of outer housing 104 abuts gasket 102. Housing 106 has thickened upper and lower walls 114, FIG. 8, and opens to the outside of door panel 22 across a rectangular peripheral shoulder 116, which is inwardly offset from outer housing 104.

The latch operating mechanism 16' of the push button type handle embodiment is shown in the inoperative position in solid lines in FIGS. 7, 8 and in the operative position in dash lines. Latch operating mechanism 16' is substantially similar to that of the first embodiment. The latch release lever 118 has clearance notches 120, FIG. 8, which allow it to clear the heads of screws 122 which join mounting plate 124 to walls 114 of inner housing 106. Screws 122 could, if desired, be inset but a thicker mounting plate would be necessary. The boss 126 of latch release lever 118 is rotatably mounted in an aperture of plate 124 and is rotatably retained by a washer 128 and clip 130.

The push button 132 has a hollow, generally rectangular shape and fits within housing 106. The side walls 133 of the button terminate in a flange 134 cushioned by gasket 135 and engageable with shoulder 116. A push rod 136 is staked at one end into a bore 138 inside of button 132 and has a square shaped bore at the other end receiving a square shaped helically twisted rod 140. A coil spring 142 surrounds rods 136 and 140 and is seated at one end against the inside of button 132 and at the other end on the base of a hollow cylindrical cap 144 which seats against the inside of mounting plate 124. Spring 142 biases button 132 outwardly and the button is located in the solid line operative position by the engagement of tapered walls 134 with shoulder 116.

When button 132 is pushed by an operator into the dash line operative position, rod 140 moves linearly through an opening 148, identical to opening 76, to rotate latch release lever 118 down to the dash line position of FIG. 8 and release the vehicle latch as in the previous embodiment through a latch release rod hooked to aperture 150. Upon release of the button 132, the lever 118 is returned to its in-operative position by spring 142. While rod 140 moves in the opposite direction from rod 70 of the first embodiment, it moves a similar distance and occupies a similar space in the direction of door panel 22'. It will be understood that other handles or actuating members could be employed to move rods 70 or 140 if desired. In addition, different lengths for latch release levers 68 and 118 and different total angles of twist in rods 70 or 140 could be employed to give different degrees of rotary motion to the latch release lever 68 or 118 without departing from the spirit of the invention.

The embodiments of the invention in which an exclusive property or privilege is claimed are defined as follows:

1. An operating handle assembly for actuating the latch of a vehicle door or the like, comprising, a mounting member adapted to be attached to the vehicle door, linearly movable actuating means associated with the mounting member, a linearly movable camming member including a helical twist, a latch release lever rotatably mounted to the mounting member so as to be able to actuate the vehicle door latch, the release lever having a camming opening which receives the camming member therethrough and has a cross-section matching the cross-section of the camming member, means operatively connecting the camming member to the actuating means, linear movement of the camming member by the actuating means moving the camming member linearly through the camming opening and rotating the latch release lever relative to the mounting member to actuate the vehicle latch.

2. An operating handle assembly for actuating the latch of a vehicle door or the like, comprising, a mounting member adapted to be attached to the vehicle door, a manually movable actuating means associated with the mounting member, an elongated rod of polygonal cross-section having a helical twist therein, means securing the rod to the actuating means for linear movement of the rod substantially normal to the mounting member, a latch release lever rotatably mounted to the mounting member for movement in a plane substantially parallel to the mounting member and having a camming opening which receives the elongated rod therethrough and has a cross-section matching the cross-section of the elongated rod, movement of the actuating means moving the rod linearly through the camming opening of the latch release lever to rotate it relative to the mounting member and release the vehicle latch.

* * * * *